US010532363B2

(12) United States Patent
Yao et al.

(10) Patent No.: US 10,532,363 B2
(45) Date of Patent: Jan. 14, 2020

(54) TWO-SIDED MAGNETIC SEPARATION DEVICE

(71) Applicants: Kang Yao, Delray Beach, FL (US); Nan An, Boynton Beach, FL (US); Khanh Duc Huynh, Medford, MA (US)

(72) Inventors: Kang Yao, Delray Beach, FL (US); Nan An, Boynton Beach, FL (US); Khanh Duc Huynh, Medford, MA (US)

(73) Assignee: Kang Yao, Delray Beach, FL (US)

( * ) Notice: Subject to any disclaimer, the term of this patent is extended or adjusted under 35 U.S.C. 154(b) by 155 days.

(21) Appl. No.: 15/861,329

(22) Filed: Jan. 3, 2018

(65) Prior Publication Data

US 2019/0201912 A1 Jul. 4, 2019

(51) Int. Cl.

*B03C 1/033* (2006.01)
*B01L 9/00* (2006.01)
*B03C 1/28* (2006.01)

(52) U.S. Cl.

CPC ..... *B03C 1/0332* (2013.01); *B01L 9/523* (2013.01); *B03C 1/288* (2013.01); *B01L 2200/02* (2013.01); *B01L 2200/028* (2013.01); *B01L 2200/0647* (2013.01); *B01L 2300/0829* (2013.01); *B01L 2400/043* (2013.01); *B03C 2201/18* (2013.01); *B03C 2201/22* (2013.01); *B03C 2201/26* (2013.01)

(58) Field of Classification Search

CPC ... B03C 1/0332; B03C 1/288; B03C 2201/26; B03C 2201/18; B01L 9/523; B01L 2200/028; B01L 2200/0647; B01L 2200/02; B01L 2300/0829; B01L 2400/043

See application file for complete search history.

(56) References Cited

U.S. PATENT DOCUMENTS 5,714,063 A * 2/1998 Brunsting ..... B01D 35/06 210/222
5,779,907 A * 7/1998 Yu ..... B01L 3/5085 210/695
8,597,510 B2 * 12/2013 Yang ..... B03C 1/0332 210/222
2002/0070173 A1 * 6/2002 Otto ..... B01L 3/5085 210/695
2003/0127396 A1 * 7/2003 Siddiqi ..... B03C 1/01 210/695

(Continued)

*Primary Examiner* — Liam Royce

(57) ABSTRACT

A magnetic separation device for immunoassay using a two-sided plate for multi-well microplate separation via a flat side containing a magnetic block and a back side of magnetic microplate structure containing a matrix of permanent magnets. The present invention relates to a multi-purpose magnetic separation device that has two sides of magnetic separation function. The flat side of magnetic separation device includes magnetic block, metal or plastic sheet surface top and a pin to secure the assay plate. The back side of magnetic separation device is a multi-well structure that includes a plurality of permanent magnets placed in the spaces between the adjacent wells. There are different magnetic configurations for the multi-well structure, which ensures that each well is pulled by at least one strong permanent magnet.

12 Claims, 10 Drawing Sheets

Typical magnet configuration

(56) References Cited

U.S. PATENT DOCUMENTS

| | | | | |
|---|---|---|---|---|
| 2004/0004523 | A1* | 1/2004 | Humphries | B03C 1/288<br>335/296 |
| 2004/0182770 | A1* | 9/2004 | Clark | B01L 3/50255<br>210/321.6 |

* cited by examiner

Detailed illustration of the separation result in a PCR well

TWO-SIDED MAGNETIC SEPARATION DEVICE

BACKGROUND OF THE INVENTION

Use of biological activated magnetic particles as a carrier for biological agent separation and purification has received great attention by researchers since late 1970's. Bio-medical equipment manufacturers have developed biological and chemical activated magnetic particles to help researchers develop novel approaches for antigen, cells separation and purification purposes in the field of molecular biology, microbiology and cellular immunology. Magnetic separation does not require sophisticated instruments, it is easy to use and efficient in cost. It has been widely used since then in the bio-medical field. There are quite some makers of the magnetic separation devices on the market. Various makers made various types of magnetic separation device to fit assay plates or PCR plates. But they all lack a magnetic separation device that can fit different kinds of assay plate and PCR plate on the market.

U.S. Pat. No. 5,779,907A discloses an apparatus for immunoassay using a 96-well microplate includes a mechanism for supporting the microplate in a relatively fixed position, a magnetic microplate assembly containing multiple cylindrical magnets positioned in 4×6 arrays for insertion from the bottom of the microplate in the spaces between the wells of the microplate. This device is designed to fit assay plate only. U.S. Pat. No. 8,597,510 B2 discloses a device magnetically separating a sample, comprising a cuboid plate and wells on bottom side, and the wells are used to accommodate magnet block. The arrangement of the wells in the cuboid plate is designed to fit the assay plates only with a magnet under each well. US20020070173 A1 discloses an apparatus and method for polymerase chain reaction (PCR) plate use in magnetic separation of magnetically attractable particles suspended in a liquid. The apparatus works well yet is designed to fit PCR plate only. According to the prior arts, the magnetic separation devices are each good in function yet with limit to the types of plates they can accommodate due to its restriction in shape and mechanism. With so many different types of microplates on the market, there is a great need for one device to fit various microplates on the market. The need is to call for a special design of magnetic separation device that is powerful, versatile, compact and affordable in price. Our invention answers this call exactly. It fits most PCR and assay plates on the market. Our device is compact yet powerful and convenient to travel with, which makes it ideal for conference use and quick deployment in a remote location.

SUMMARY OF THE INVENTION

This invention relates to a device for applying a strong magnetic field to liquids in various PCR and assay plates. The device is a two-sided structure of magnetic field that provides the separation function to the liquids in various PCR and assay plates. Both sides are connected by the mounting metal plate in the middle. One side of magnetic separation device is a flat surface consisting of magnetic block, sheet metal or plastic sheet on top surface and a pin to secure the assay plate. This flat side is designed to magnetically separate the sample in the assay plate. The magnet block comprises one piece of permanent magnet or the composite magnet structure. Metal or plastic sheet is used to cover the magnetic block, which makes the working surface easy to clean and maintain. This flat side of the magnetic separation device can fit all assay plates on the market. A magnetic position locker (MPL) is also designed as an option to help secure the PCR plate shall it be desired to use on the flat side. The MPL is adjustable in position on the flat side surface due to the magnetic attraction. Once positioned on the flat side, the PCR plate can be secured on top of the MPL for a quick separation of the sample accordingly. The corner legs support the plate and also help position the assay plate.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

In FIG. 1, the corner support legs (a and b) are designed to help position the assay plate for quick mounting and dismounting from the flat side.

In FIG. 2, the assay plate fits onto the flat side of the two-sided magnetic separation device.

FIGS. 3*a* and 3*b* show how the MPL (magnetic position locker) can be used to secure the PCR plate onto the flat side for quick separation. The MPL is in a cross shape to fit into the bottom grove of the PCR plates. MPL is made of iron, steel or the composite structure that can be attracted to the magnets block.

In FIG. 4, the back side of magnetic separation device uses a multi-well structure to fit the PCR plate as well as housing the magnets. The magnetic matrix varies in configuration, as shown in FIG. 4*a*-4*d*. Row 1 varies in the number of the magnets and Row 2 is optional depending on the requirement of the overall magnetism. These configurations help form a unique sequence of the magnetism applied to the samples in the wells of the PCR plate. The magnets are embedded inside the pin hole of the multi-well structure. The magnets are polarized laterally. The magnet matrix of the back side can be changed to achieve the optimized magnetism for the separation of the sample in the PCR wells.

In FIG. 5, the PCR plate with sample fits snugly into the multi-well structure. The sample of PCR plate is laterally attracted by the magnets in the multi-well structure. This makes it easy to operate and observe. The mounting metal plate is placed between the flat side and back side. It connects both sides into one compact yet powerful unit. The metal plate also effectively improves the working surface magnetism by reflection of the magnet block on the flat side.

FIG. 6 is a side view showing how sample particles in the PCR plate are laterally attracted by the magnet in the multi-well structure.

REFERENCE

Figure 1:
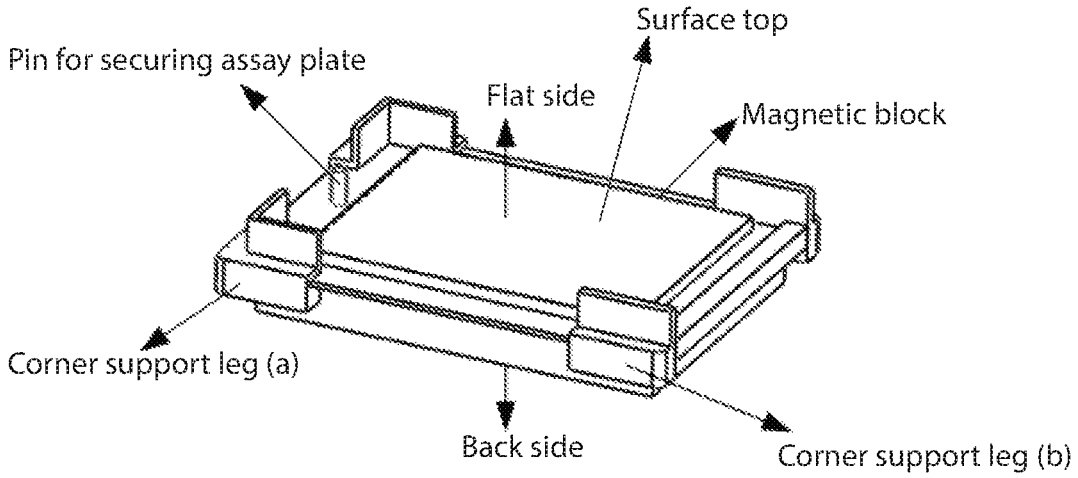
FIG. 1 shows an overall view of the two-sided magnetic separation device.
Figure 2:
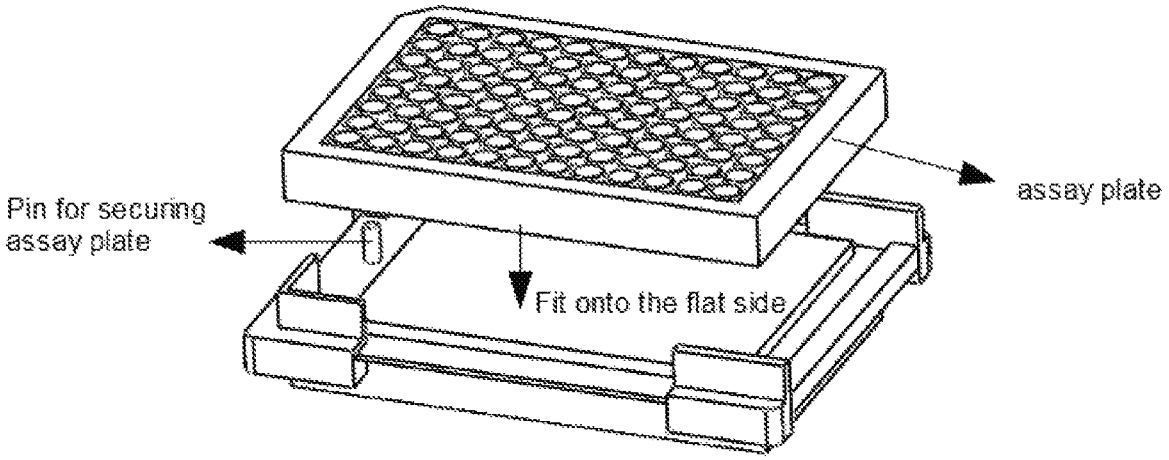
FIG. 2 shows an overall view of the assay plate fitting onto the flat side of the two-sided magnetic separation device.
Figure 3A:
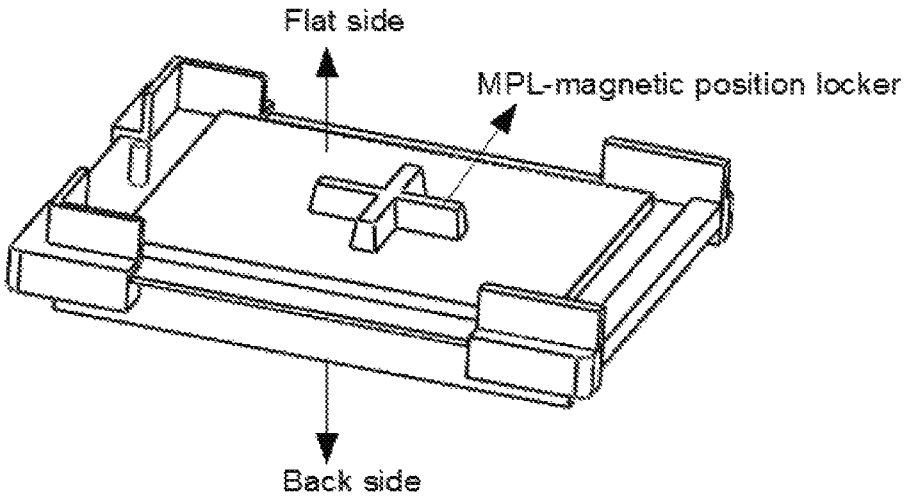
FIGS. 3*a* and 3*b* show how the MPL (magnetic position locker) can be used to secure the PCR plate on top of the flat side.
Figure 3B:
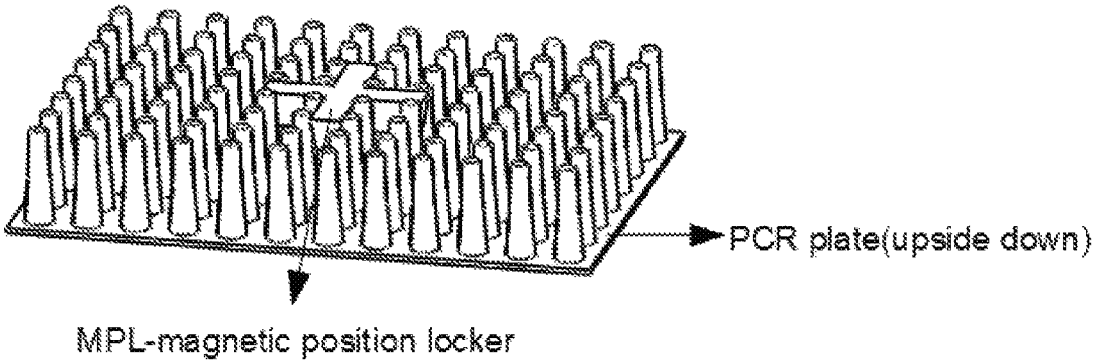
Figure 4A:
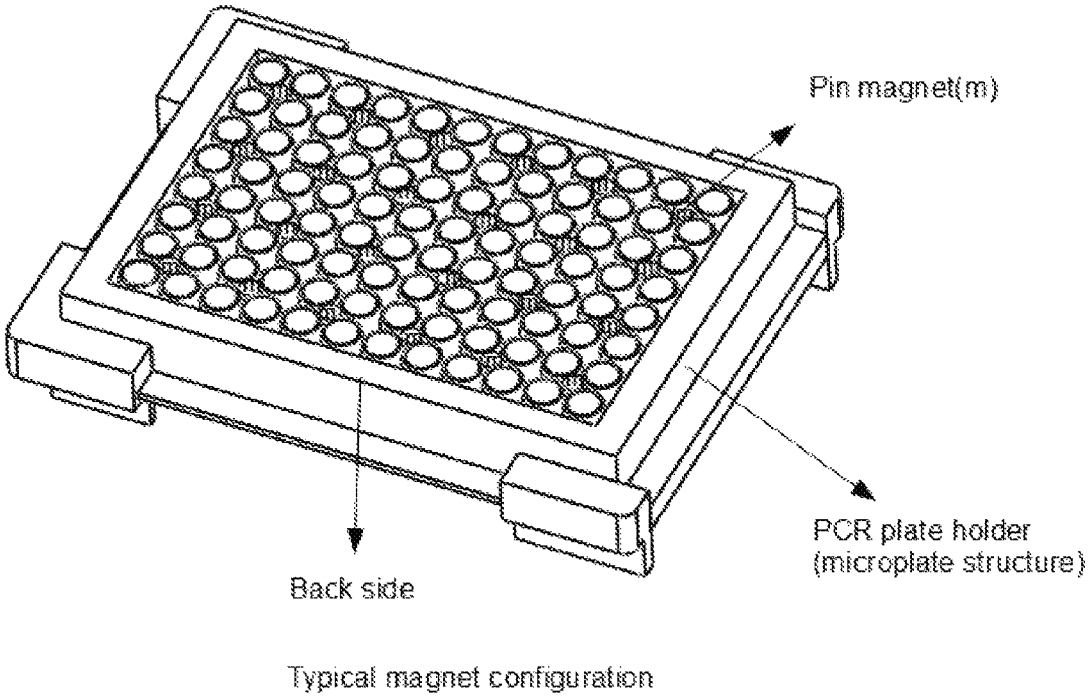
FIG. 4*a*,4*b*,4*c*,4*d* show a schematic view of the four different magnet configuration in the back side of the magnetic separation device. Row 1 varies in the number of the magnets and Row 2 is optional depending on the requirement of the overall magnetism.
Figure 4B:
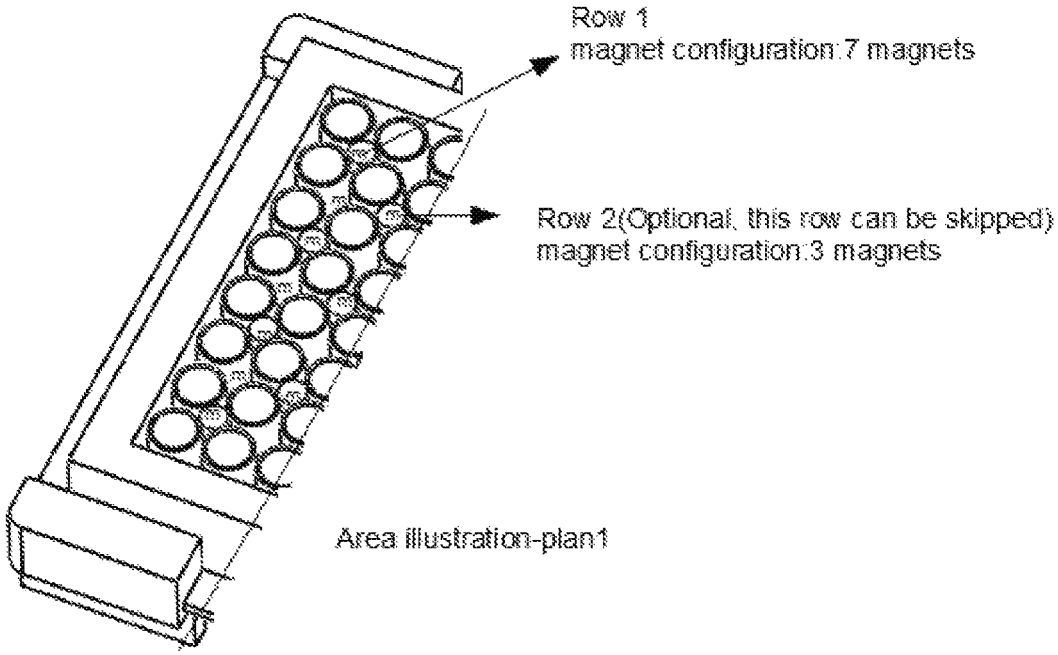
Figure 4C:
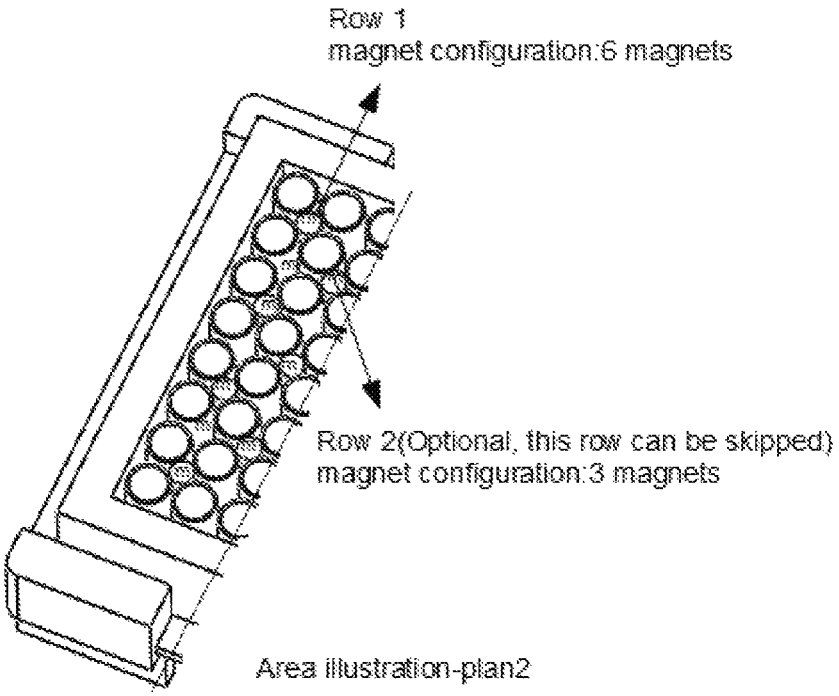
Figure 4D:
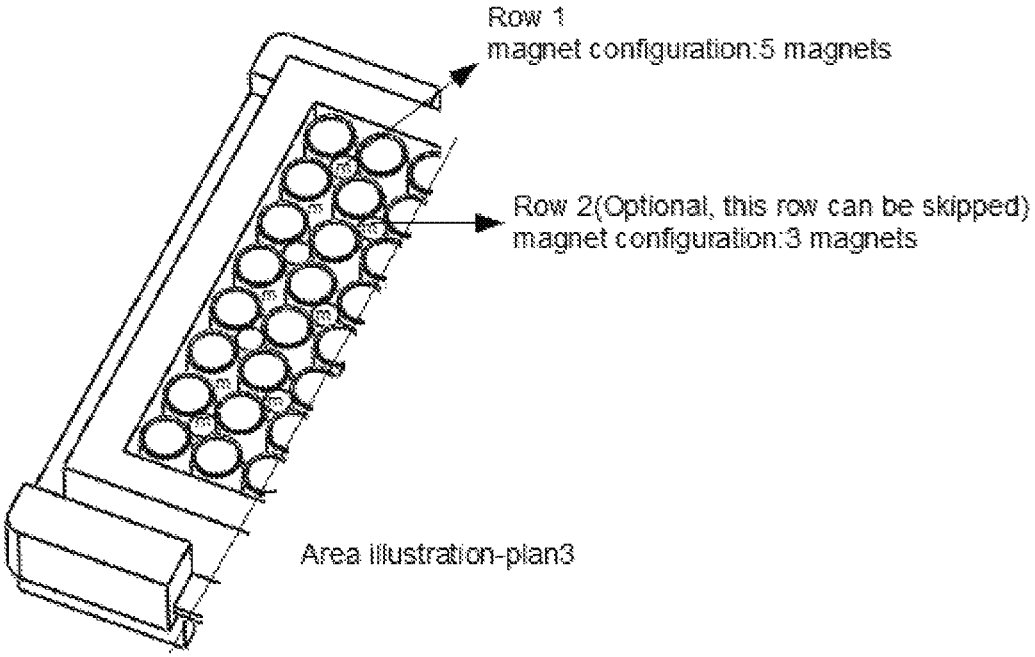
Figure 5:
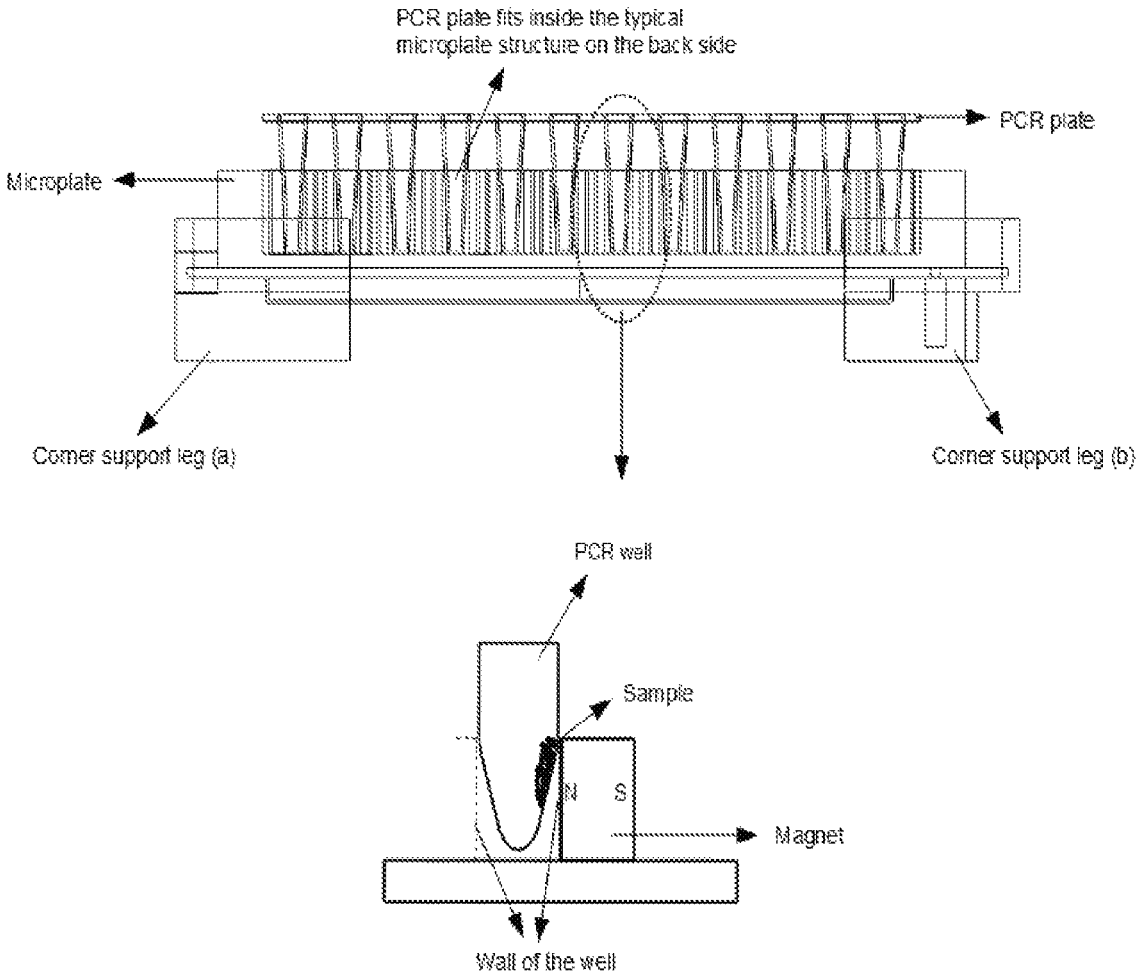
FIG. 5 shows a schematic view of the PCR plate fitting into the back side of the magnetic separation device and a detailed illustration of the separation result in a PCR well.
Figure 6:
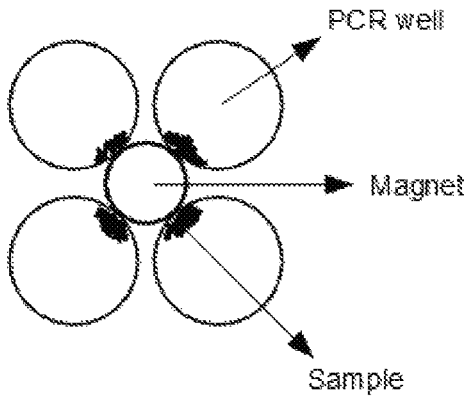
FIG. 6 shows a top view of the samples in the PCR wells attracted by a pin magnet.

1. U.S. Pat. No. 5,779,907A, Dec. 6, 1996-Jul. 14, 1998. Systems Research Laboratories, Inc. Magnetic microplate separator.
2. U.S. Pat. No. 8,597,510 B2, Oct. 22, 2010-Dec. 3, 2013. Magqu Co. Ltd. Device of magnetically separating a sample.
3. US20020070173 A1, Dec. 8, 2000-Jun. 13, 2002. Promega Corporation. Apparatus and method for use in magnetic separation of magnetically attractable particles in a liquid.

What is claimed is:

1. A magnetic separation device composed of:

a magnetic flat side to fit an assay plate or a PCR plate;

a back side of multi-well structure to fit PCR plate only.

2. The magnetic separation device of claim 1, wherein the magnetic flat side is embedded with a magnetic block and a surface top.

3. The magnetic separation device of claim 2, wherein a pin is on the magnetic flat side to secure the assay plate from moving around.

4. The magnetic separation device of claim 2, wherein corner legs support the magnetic separation device and hold the assay plate in place.

5. The magnetic separation device of claim 2, wherein a mounting metal plate is placed in a mid-section of the device to connect the magnetic flat side and the back side into one unit.

6. The magnetic separation device of claim 5, wherein the mounting metal plate in the mid-section strengthens the magnetism of the magnetic block on the magnetic flat side.

7. The magnetic separation device of claim 6, wherein the mounting metal plate in the mid-section can be adjusted in number and thickness to tune the strength of the magnetism on the magnetic flat side.

8. The magnetic separation device of claim 7, wherein the thickness of the mounting metal plate in the mid-section is adjustable in the range from 0.5 mm to 3 mm.

9. The magnetic separation device of claim 1, wherein the back side is composed of a multi-well structure with embedded magnets in a matrix configuration and the number of the wells is up to 384.

10. The magnetic separation device of claim 9, wherein each well on the back side is shaped to fit the PCR plate.

11. The magnetic separation device of claim 9, wherein the magnetic matrix on the back side is formed by the magnets that are polarized laterally to attract a sample in the PCR plate to a wall of each well in the plate.

12. The magnetic separation device of claim 1, further comprising a magnetic position locker.

* * * * *